US006173510B1

(12) United States Patent
Zanco

(10) Patent No.: US 6,173,510 B1
(45) **Date of Patent: *Jan. 16, 2001**

(54) BOOT FOR A GLIDING SPORT, IN PARTICULAR AN ALPINE SKI BOOT

(75) Inventor: Alain Zanco, Voiron (FR)

(73) Assignee: Skis Rossignol S.A., Voiron (FR)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/173,534

(22) Filed: Oct. 15, 1998

(30) Foreign Application Priority Data

Oct. 17, 1997 (FR) ..... 97 13259

(51) Int. Cl.[7] ..... A43B 5/04

(52) U.S. Cl. ..... 36/119.1; 36/117.4; 36/103; 36/31; 36/117.3

(58) Field of Search ..... 36/115, 117.1, 36/117.3, 117.4, 118.2, 119.1, 31, 103, 102, 117.2

(56) References Cited

U.S. PATENT DOCUMENTS

| | | | | |
|---|---|---|---|---|
| 4,677,769 | * | 7/1987 | Ahmad et al. | 36/117.4 |
| 4,839,972 | * | 6/1989 | Pack et al. | 36/117.4 |
| 5,572,806 | * | 11/1996 | Osawa | 36/117.4 |
| 5,771,609 | * | 6/1998 | Messmer | 36/115 |
| 5,815,952 | * | 10/1998 | Bobrowicz | 36/117.3 |
| 5,884,420 | * | 3/1999 | Donnadieu | 36/117.5 |
| 5,899,006 | * | 5/1999 | Donnadieu | 36/97 |

FOREIGN PATENT DOCUMENTS

| | | | | |
|---|---|---|---|---|
| 865425 | * | 2/1953 | (DE) | 36/117.1 |
| 2514207 | * | 10/1976 | (DE) | 36/117.4 |
| 196 16 559 | | 7/1997 | (DE) . | |
| 0 086 149 | | 8/1983 | (EP) . | |
| 342462 | * | 11/1989 | (EP) | 36/117.3 |
| 0 416 437 | | 3/1991 | (EP) . | |
| 0 753 267 | | 1/1997 | (EP) . | |
| 2 309 168 | | 11/1976 | (FR) . | |

* cited by examiner

*Primary Examiner*—Paul T. Sewell
*Assistant Examiner*—Jila Mohandesi
(74) *Attorney, Agent, or Firm*—Bugnion S.A.; John Moetteli

(57) ABSTRACT

The boot is one wherein the rear part of its sole (13), between the heel and approximately the middle of the sole, and the lower rear part of the upper (12) are rigid, while the rest of the upper (11) and of the sole (16) are flexible. This boot makes it possible to walk with ease and can be fixed on a gliding board while perfectly fulfilling its function as an interface between the leg and the binding.

5 Claims, 3 Drawing Sheets

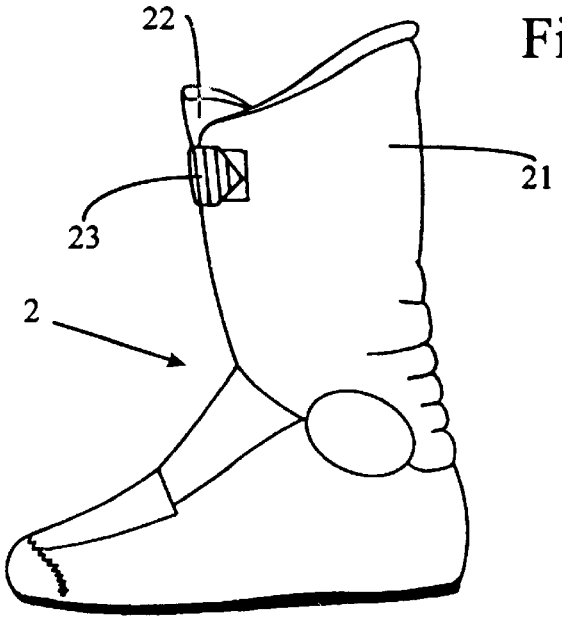
Fig.1
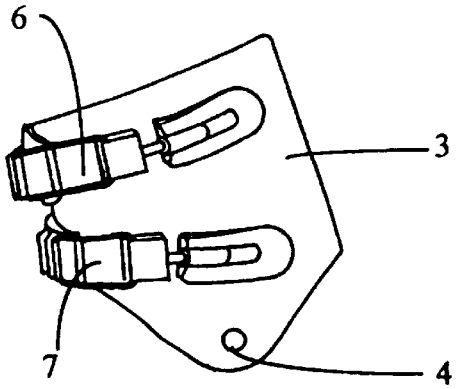
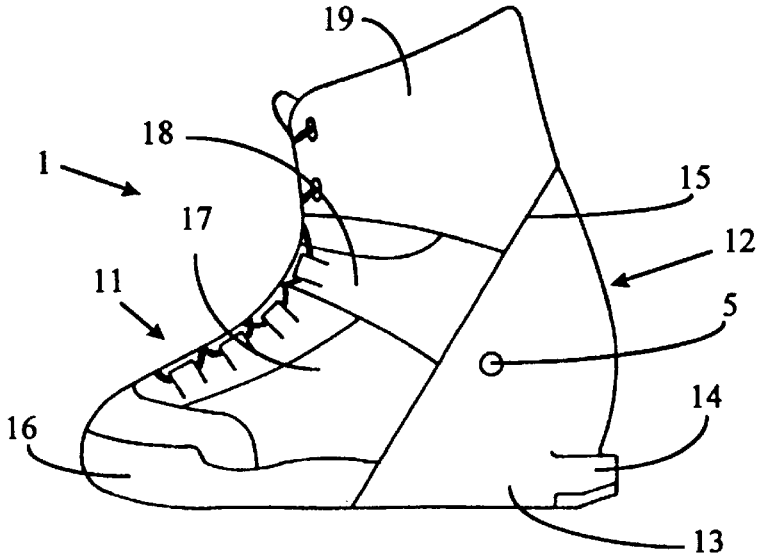

Fig.8
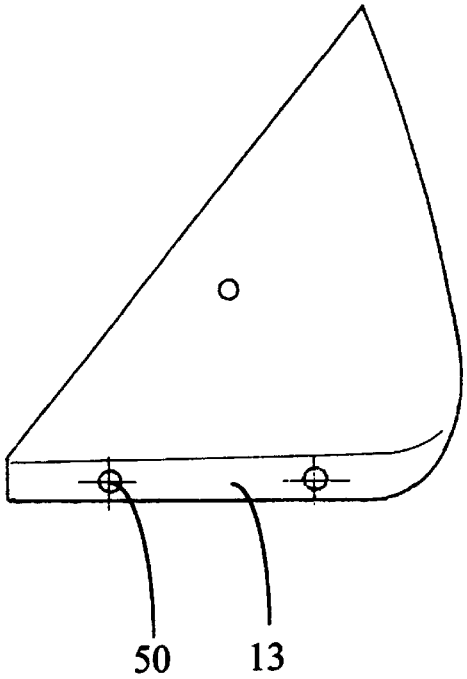
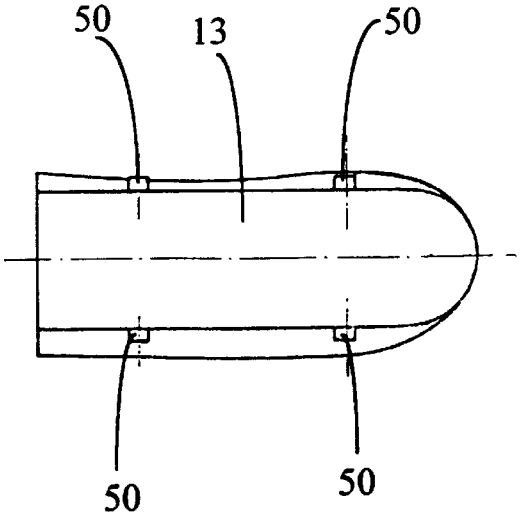
Fig.9

BOOT FOR A GLIDING SPORT, IN PARTICULAR AN ALPINE SKI BOOT

FIELD OF THE INVENTION

The invention relates to a boot for a gliding sport, in particular an alpine ski boot.

PRIOR ART

Since the appearance of injection-molded plastic boots which took over from leather boots, the most common type of boot has been one which essentially consists, on the outside, of a shell providing proper support for the foot and having a rigid sole whose ends are gripped by the elements of the ski binding and, on the inside, of a comfort liner.

This type of boot is particularly suitable for good skiing, but it is unsuitable for walking because the shell, and in particular the sole, has no flexibility in the metartasophalangeal zone to allow the foot to roll during walking.

For a number of years, attempts have been made to eliminate this drawback, that is to say to make it easier to walk with alpine ski boots, using a variety of methods. In patent EP 0 664 969, it was proposed to provide a flexible zone forming a hinge in the metartasophalangeal zone of the rigid sole, and to divide the shell of the boot into two parts that are articulated at said articulation, these two parts also being joined by a device allowing the articulation to be locked. The articulation created in this way does indeed make it easier to walk, but the rigidity remaining to the front and to the rear of the articulation does not allow the foot to roll smoothly, as happens naturally during walking. Further, the discontinuity of the shell in its anterior part creates waterproofing problems.

A boot designed using a similar principle is also known from patent U.S. Pat. No. 5,572,806. In this boot, locking is provided by a device sliding in the thickness of the sole. Above the articulation, the upper has a fold which is intended to give the upper some degree of flexibility while maintaining the continuity of the upper, that is to say keeping it waterproof. It is clear that a boot of this type has little flexibility in the metartasophalangeal region.

For snowboarding, which involves a great deal of walking, it is known to use soft flexible boots. However, boots of this type are not suitable for alpine skiing because their flexibility prevents the use of automatic release bindings. It has been proposed, in patent application EP 0 753 267, to rigidify a soft boot of this type using an inner shell and an articulated rigid dorsal part, that is to say by means added to the soft boot.

Moreover, patent FR 2 309 168 discloses a boot for ski touring in which the front part has a flexible sole intended to make it easier to walk. The front end of the boot is, however, designed in a traditional way for it to be held by a binding.

SUMMARY OF THE INVENTION

The object of the invention is to provide the user with a boot, in particular a ski boot, which makes it possible to walk with ease, for example as a walking or mountaineering boot does, and which can be fixed on a gliding board, in particular a ski, by means of a binding while perfectly fulfilling its function as an interface between the leg and the binding.

To this end, the boot according to the invention is one wherein the rear part of its sole, between the heel and approximately the middle of the sole, and the lower rear part of the upper are rigid, while the rest of the upper and of the sole are flexible.

A boot of this type has the appearance of a hybrid boot, the rear of which corresponds to that of a conventional plastic ski boot, while the rest of the boot has the characteristics of a walking boot. The rigidity is not obtained by parts that are added on.

The flexible part may consist of a variety of materials, such as plastic, leather, rubber or a combination of these materials. As regards the rigid part, a customary material such as polyurethane will be used. Seen from the side, the front end of the boot is advantageously rounded in order to make it easier to walk.

The rigid part of the sole will be designed in such a way as to fulfill its function as an interface. It may have auxiliary means such as pins, bars, etc.

The boot will advantageously be provided with a lower leg cuff articulated to the rigid part of the boot.

BRIEF DESCRIPTION OF THE DRAWINGS

The appended drawing represents some embodiments of the boot according to the invention by way of example.

By means of an illustrative embodiment, FIG. 1 illustrates the principle of the boot according to the invention.

FIGS. 8 and 9 respectively represent a side view and a bottom view of a fourth embodiment of the rigid part.

DESCRIPTION OF THE PREFERRED EMBODIMENTS

Figure 2:
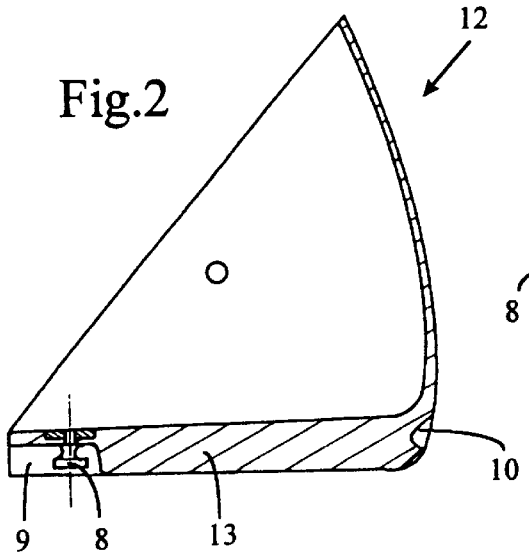
FIGS. 2 and 3 respectively represent a longitudinal vertical section and a bottom view of the rigid part of the boot according to a first embodiment.

The boot represented in FIG. 1 essentially consists of an outer boot 1 and a comfort liner 2 intended to be placed inside the boot 1.

The boot 1 consists of a flexible part 11 and a rigid part 12. The liner 2, which is of known design, has a part 21, intended to enclose the lower leg and opening toward the front, and supplemented by a tongue 22 for supporting the tibia. The part 21 can be kept closed and tightened around the leg by means of a strap 23.

The rigid part 12 of the boot comprises a lower part 13 which forms approximately one half of the length of the sole and has, at the rear, a bearing part 14 intended to accommodate a rear ski binding element, as well as a front binding means. The rigid part 12 also extends around and over the heel, while partially covering the malleolar zone, and is bounded toward the front, on each side of the upper, by an oblique edge 15 with a slope of about 50°. In the example which is represented, the flexible part 11 has a rubber or plastic sole 16 and an upper consisting of several leather or plastic parts 17, 18, 19. In the example which is represented, the boot is closed and tightened by a lacing system, but this function could be fulfilled by buckles.

The materials which are used may be, for example, for the rigid part, a commonly used plastic, a homogeneous or heterogeneous or composite material, and for the flexible part a material used for traditional walking boots, for example leather, simple fabric or coated fabric.

The boot may be supplemented by a cuff 3 which articulates via points 4 to points 5 on the rigid part 12 of the boot, that is to say in the malleolar region. The cuff 3 is provided with closure buckles 6 and 7. The cuff could be rendered lighter by one or more cutouts.

In this embodiment, the flexible part 11 of the boot comprises only the means intended to provide waterproofing, with the means intended to provide comfort all forming part of the liner 2. In some embodiments, the liner 2 could be omitted, with the means providing comfort forming an integral part of the upper of the boot.

In order to fulfill its function as an interface with a binding, in particular a ski binding, the sole part 13 of the rigid part 12 of the boot must have appropriate means. Some examples are illustrated by FIGS. 2 to 9.

Figure 3:
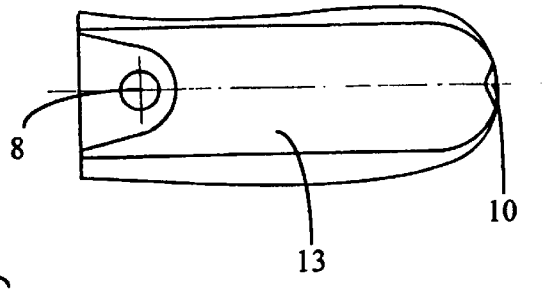

In the embodiment which is represented in FIGS. 2 and 3, the sole 13 has a vertical pin 8 which is profiled in the shape of a button and set back in a recess 9 of the sole and, at the rear, a hollow 10 intended to accommodate a longitudinal finger of a binding.

Figure 4:
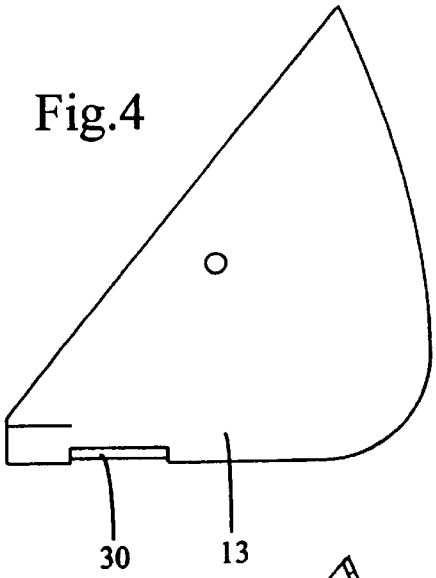
FIGS. 4 and 5 respectively represent a side view and a bottom view of a second embodiment of the rigid part.
Figure 5:
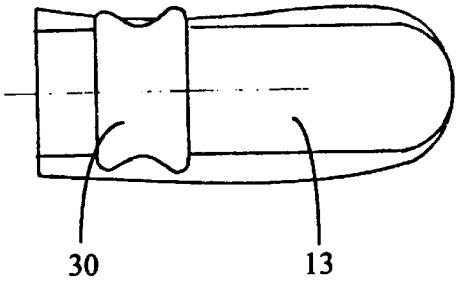

In the embodiment which is represented in FIGS. 4 and 5, the sole 13 of the rigid part has a profiled part 30, under the arch of the foot, this profiled part by itself providing the connection between the boot and the binding.

Figure 6:
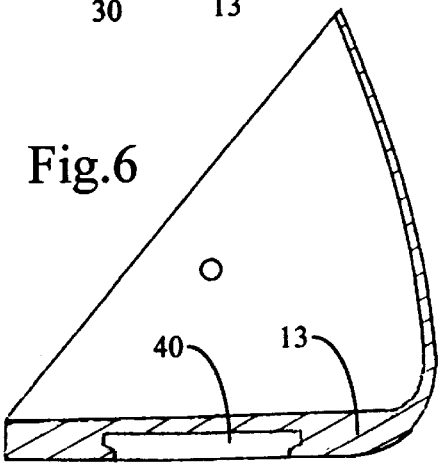
FIGS. 6 and 7 respectively represent a longitudinal vertical section and a bottom view of a third embodiment of the rigid part.
Figure 7:
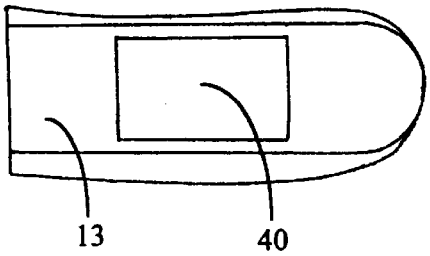

In the embodiment which is represented in FIGS. 6 and 7, the sole 13 has a hollow imprint 40 which, in longitudinal section according to FIG. 6, has a T-shaped or dovetail profile in which expandable grippers of the ski binding, or the like, attach.

In the embodiment which is represented in FIGS. 8 and 9, the sole 13 is provided with two pairs of lateral pins 50 which are intended to engage in binding notches in which they are locked.

In all cases, the rigid part 13 of the sole of the boot may have standardized binding means independent of the boot size.

The rigid part 12 could be cut out or openworked on the sides and/or on the back. It could have oblique tabs directed forward, for example toward the instep and constituting straps intended to support tightening means such as buckles or the like.

What is claimed is:

1. A boot for a gliding sport having rigid and flexible portions affixed to each other and including a binding interface, wherein the rigid portion is a monolithic material, disposed on the exterior of the boot, around and over the heel, only between approximately the middle of the sole of the boot to the rear part of the sole (13) of the boot, to the lower rear part of the upper (12) of the boot, and the flexible portion consists of the rest of the upper (11) and of the sole (16), and wherein the binding interface (9, 10; 30; 40; 50) is formed as part of the rigid portion in such a manner as to form the entire binding interface with the ski, the interface interacting with an automatic release binding.

2. The boot as claimed in claim 1, wherein the rigid and flexible parts are made of different types of material.

3. The boot as claimed in claim 1, equipped with a lower leg cuff (3) articulated to the rigid portion (12).

4. The boot as claimed in claim 1, comprising an inner comfort liner (2) in the form of a soft boot.

5. The boot as claimed in claim 1, wherein the rigid rear part of the upper is openworked or cut out.

* * * * *